United States Patent [19]

Hodge

[11] Patent Number: 4,850,051

[45] Date of Patent: Jul. 25, 1989

[54] APRON FASTENER

[76] Inventor: Allan M. Hodge, P.O. Box 202005, San Diego, Calif. 92120-0925

[21] Appl. No.: 235,430

[22] Filed: Aug. 23, 1988

[51] Int. Cl.[4] ..... A41D 13/04

[52] U.S. Cl. ..... 2/52; 2/48; 2/257; 2/260

[58] Field of Search ..... 2/48, 49 R, 49 A, 50, 2/51, 52, DIG. 6

[56] References Cited

U.S. PATENT DOCUMENTS

| | | | |
|---|---|---|---|
| 945,345 | 1/1910 | Richards | 2/51 |
| 1,933,185 | 10/1933 | Rouleau | 2/48 |
| 2,629,871 | 3/1953 | Greene | 2/51 |
| 2,670,469 | 3/1954 | Danziger | 2/52 |

OTHER PUBLICATIONS

Gershman, Maurice, "Self Adhering Nylon Tapes." The J.A.M.A., vol. 168, No. 7—10/1958.

*Primary Examiner*—Werner H. Schroeder
*Assistant Examiner*—Jeanette E. Chapman
*Attorney, Agent, or Firm*—Poms, Smith, Lande, & Rose

[57] ABSTRACT

A shop apron is provided with two straps extending from the upper right and left corners, respectively, of the apron, and two grommets having holes of a predetermined diameter, with the grommets being secured in and to the right and left sides of the apron. Each one of the straps are then led over each shoulder, across the back, threaded through grommetes on the other side of the apron, then brought across the back and tied to a fastener tab having Velcro-type material on its surface. Then, the straps are tightened and the tabs simply pressed together to fasten straps across the back. The apron may be taken off by detaching the tabs from each other, and are easily put back on by bringing the left arm, right arm and head through the straps and then simply pressing the tabs together to fasten the straps across the back .

10 Claims, 1 Drawing Sheet

APRON FASTENER

FIELD OF THE INVENTION

This invention relates to fastening arrangements for shop aprons.

BACKGROUND OF THE INVENTION

Shop aprons are worn by people working in machine shops or factories shops for preventing manufacturing oils, debris, dust, or other undesirable material from coming in contact with their body or clothes. The workers normally take off the shop apron when leaving the factory floor and put it back on when returning to the factory floor.

Unfortunately, putting an apron on may be a cumbersome task due to the way that straps are worn to hold the apron on the person's body. Normally, each of the two straps which hold the apron on the person must be led from the upper front on one side, over each shoulder, across the back, individually threaded through grommets on the other side of the apron, then brought across the back again and tied. This is an awkward and time-consuming task, and worst of all, it must be repeated each time the apron is taken off and put back on.

Accordingly, the principal object of the present invention is to make the task of putting an apron on easier and less time-consuming.

SUMMARY OF THE INVENTION

An apron fastener assembly, in accordance with the present invention, includes two rigid support tabs, a Velcro-type material on an outer portion of one of the rigid tabs, and a mating second Velcro-type material on an outer portion of the other rigid tab. The tabs include fastening means for fastening the tabs to the apron straps. The fastening means may include an opening on the surface of each tab for threading each strap through the opening and tying the strap to the tab. Further, the relative size of the tabs with respect to the grommets is such that the tabs are prevented from passing through the grommets. With the tabs tied to the straps, the end of the straps are also prevented from passing through the grommets. Thus, when the apron is taken off, the straps remain threaded through the grommets and crossed similar to the manner that the apron is normally worn. As a result, the worker may put the apron back on by simply putting the straps across the head and shoulders in the same manner that the apron was previously worn. It is noted that normally the straps must be led over each shoulder, crossed across the back, individually threaded through the grommets on each side of the apron, then brought across the back again and tied.

Using the apron fastener assembly in accordance with the present invention, most of the above-mentioned steps are not needed because the straps are already crossed and threaded through the grommets. As mentioned above, the apron may easily be worn by putting the head and arms through the straps and then readily fastening the tabs by pressing them together.

Accordingly, the process of putting the apron on is made faster and easier because the strap ends are prevented from passing through the grommets and the manner in which the straps are crossed and threaded through the grommets is left intact when the apron is taken off. Further, fastening the straps is faster and easier because it can be done by pressing the two tabs together. Contrast this easy and quick method of pressing tabs together with the more time-consuming method of tying a knot, especially when the knot is made near the person's lower back.

The tabs are normally made of a thin rigid plate. The rigid plate may be made of a metal alloy. Due to the relatively small size and simple shape, the tabs are inexpensive and practical for use in the apron fastener assembly. Further, the shape and size of the tabs may be varied if desired, so long as the relative size of the tabs with respect to the grommets is such that the tabs are prevented from passing through the grommets.

The Velcro-type material may be used to cover most of the tab surface area. The surface of the Velcro-type material on one tab may include many small loops, while the surface of the Velcro-type material on the mating tab may include arrays of small hooks. With this arrangement, when the tabs are pressed together, in virtually any manner, the hooks on one tab securely engage the loops on the mating tab.

A small metal loop or ring may be interlocked with the tab to fasten the straps to the tabs. The metal loops may be of the split ring wire type used for keys, in which the wire from which the ring is made makes nearly two full turns, and may be spread too secure it to a key, or the tabs, for example. With this arrangement, the loop may be interlocked with the opening on the surface of the tab. Then, the end of each strap may be tied to one of the loops. Accordingly, fastening the straps to the loops may be somewhat easier than fastening them to the openings on the tabs due to the larger openings of the loops as compared to the openings on the tabs. Alternatively, if it is desired to tie the straps directly to the tabs the opening on the tab surface may be made larger to facilitate fastening of the straps to the tabs.

Accordingly, by using apron fasteners in accordance with the present invention, the aprons may be put on with significant ease and relatively quickly.

Other objects, features and advantages of the invention will become apparent from a consideration of the following detailed description and the accompanying drawings.

DETAILED DESCRIPTION OF THE DRAWINGS

Figure 1:
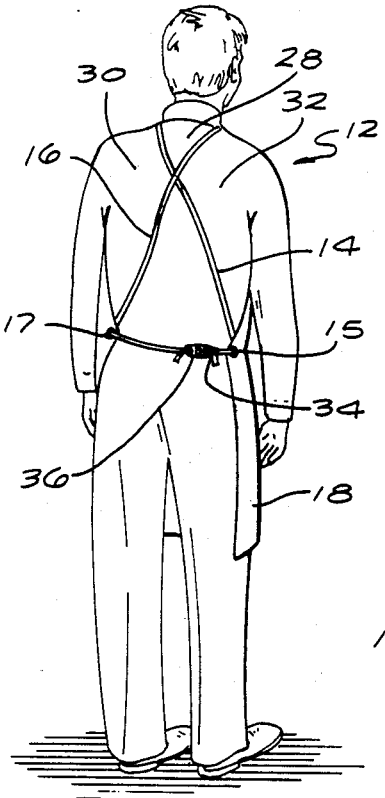
FIG. 1 illustrates the principles of the invention by showing the use of a simple apron fastener assembly for fastening the apron straps across a person's back.

Referring more particularly to the drawings, FIG. 1 illustrates the principles of the invention by showing the use of a simple apron fastener assembly 12 for holding apron 18 on a person's body. As shown in FIG. 1, straps 14 and 16 are led over each shoulder, crossed across the back, individually threaded through grommets 15 and 17, tied to fasteners 34 and 36, respectively, then fastened across the back.

Figure 2:
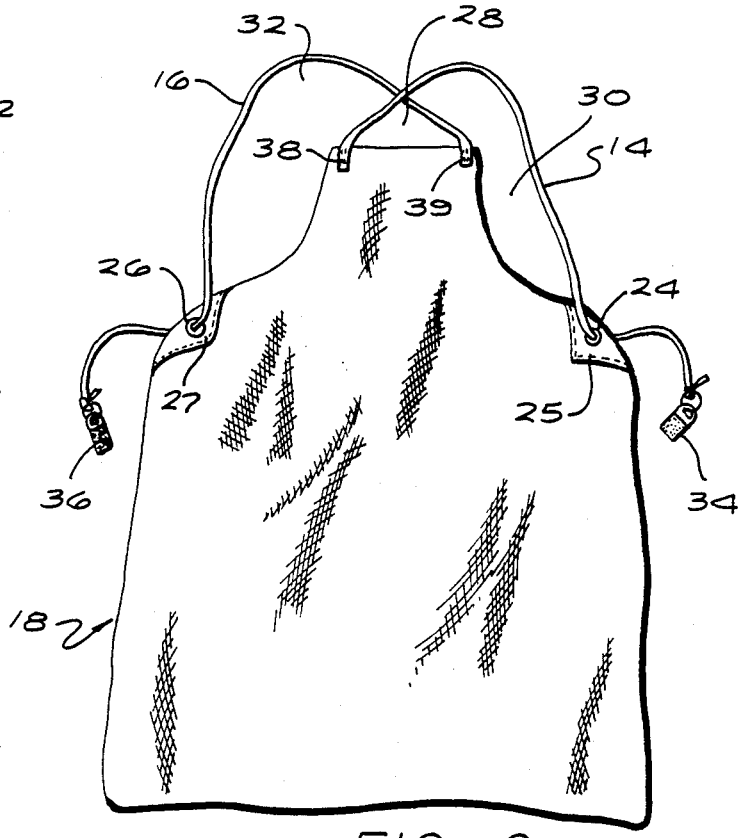
FIG. 2 is a front view of an apron and an apron fastener assembly including two apron fastener tabs that are tied to the two apron straps.

FIG. 2 illustrates apron. 18 as taken off by the person in FIG. 1. As shown in FIG. 2, the relative size of the fastener tabs 34 and 36 with respect to the grommets 15 and 17 is such that the tabs 34 and 36 are prevented from passing through grommets 24 and 26, respectively. As a result, the manner in which the person in FIG. 1 is wearing the apron, with the straps crossed and threaded through the grommets, is left intact when the apron 18 is taken off. As shown in FIG. 2, straps 14 and 16 have remained crossed in the same manner as when they are worn by the person in FIG. 1, and continue to be threaded through the grommets 15 and 17, respectively. In order to put the apron 18 back on, the person's left arm, right arm and head are brought through the spaces 30, 32 and 28, respectively, as shown in FIG. 1 and FIG. 2. Then, the straps are tightened and tabs 34 and 36 are simply pressed together to fasten straps 14 and 16 across the back.

Figure 3A:
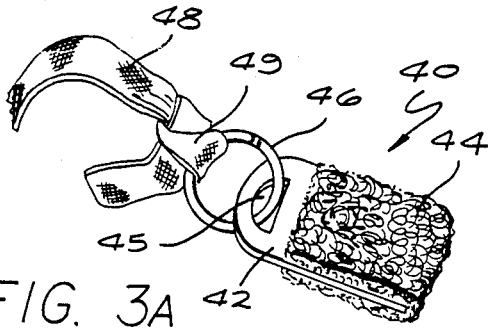
FIG. 3A is an isometric view of an apron fastener tab including a thin rigid plate covered by Velcro-type material having small loops on its surface, and a loop or ring interlocked with the tab.

FIG. 3A is an isometric view of an apron fastener tab 40 including a thin rigid plate or support means 42 covered by a pad of Velcro-type material 44, and a loop 46 interlinked with the opening 45 in the tab 40. As shown in FIG. 3A, the Velcro-type material 44 includes a multitude of fine loops that securely engage the hooks on the surface of tab 50 in FIG. 3B when the two tabs 40 and 50 are pressed together. The shape and size of the thin rigid plate are such that the plate is prevented from passing through the grommets. In one embodiment which has been tested and found satisfactory, the plates of the fastener tabs were made of aluminum, about 1/32 inch thick, $\frac{5}{8}$ inch wide and 1 and $\frac{3}{8}$ inches long. The rings or loops were formed of stainless steel and had an inner diameter of about $\frac{1}{2}$ inch. The openings through the grommets in the apron have a diameter in the order of $\frac{3}{8}$ inch, less than the cross-sectional size of the rings or loops, and also less than the cross-sectional size of the fastening tabs, so that neither the rings nor the fastener tabs will pass through the grommets. The plate may be thicker or thinner or have other desirable sizes or shapes.

Further, the relative sizes of the loop 46 and the opening 45 are illustrated. As shown in FIG. 3A, the opening through loop or ring 46 is larger than the opening 45 of tab 40. Thus, it is somewhat easier to tie strap 48 to ring 46. However, strap 48 may be tied directly to tab 40 using opening 45.

Figure 3B:
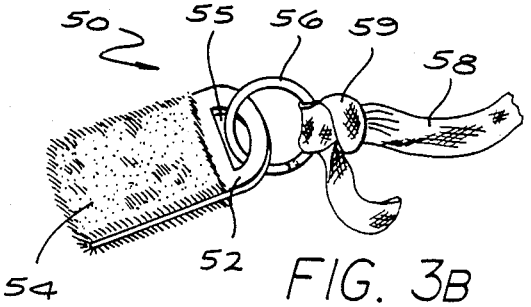
FIG. 3B is an isometric view of a second apron fastener tab including a thin rigid plate covered by Velcro-type material having hooks on its surface, and a loop or ring interlocked with the tab.

FIG. 3B is an isometric view of an apron fastener tab 50 including a thin rigid plate 52 covered by Velcro-type material 54, and a loop or ring 56 interlocked with the opening 55 on the surface of tab 50. As shown in FIG. 3B, the Velcro-type material 54 includes an array of fine hooks that securely engage the fine loops on the surface of tab 40 in FIG. 3A.

Figure 4A:
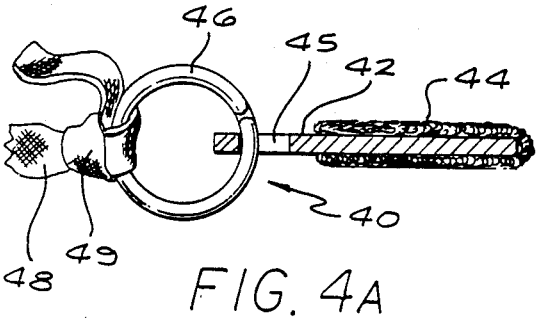
FIG. 4A is a cross-sectional view of the apron fastener tab of FIG. 3A, illustrating the small loops on the surface of the Velcro-type material.

FIG. 4A is a cross-sectional view of the apron fastener tab 40 in FIG. 3A. As shown in FIG. 4A, the rigid plate 42 is relatively thin. Further, the Velcro-type material covers most of the surface area of plate 42.

Opening 45 may be used for typing strap 48 to plate 42, or alternatively, it may be used for interlocking ring 46 with plate 42.

As noted above, it is normally easier to tie strap 48 to ring 46 because ring 46 normally has a larger opening than opening 45 in the tab. In addition, the ring may be made of rigid or flexible material, with a wire ring of the type used for keys being preferred.

Figure 4B:
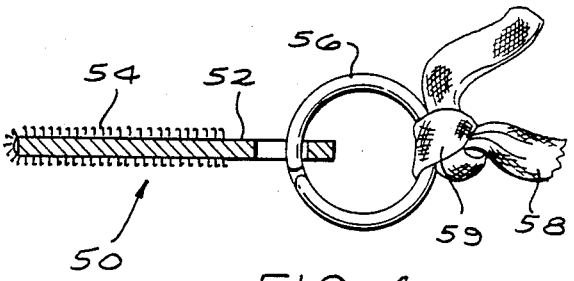
FIG. 4B is a cross-sectional view of the apron fastener tab of FIG. 3B, illustrating the fine hooks on the surface of the Velcro-type material.

FIG. 4B is a cross-sectional view of the apron fastener tab 50 in FIG. 3B. The fastener tab 50 is substantially similar in most respects to fastener tab 40 in FIG. 4A. One significant difference between the two tabs is the texture of the Velcro-type material on their surfaces. The Velcro-type material 54 includes an array of hooks that get entangled and securely engage with the multitude of loops on the Velcro-type material 44 of tab 40.

It is noted in passing that tab 40 may have other desired shapes, such as a circular or triangular shape; the plate 42 may be rigid or softer, and may be made of plastic, rubber or metal; the Velcro-type material may cover less or more area on the surface of plate 42; ring 46 may be rigid or soft, and may be made of metallic or non-metallic material. In addition, two or more tabs may be fastened together. In this instance, the apron may include two or more straps, with each strap tied to a fastening tab, like tab 40 in FIG. 3A. In this manner, the straps may be fastened together by pressing their respective fastener tabs together. The result may be a stack of fastener tabs that are secured together In this configuration, there may not be a need for grommets or a need to thread straps through the grommets. For example, the apron 18 in FIG. 2 may include four straps that are sewed to the apron at locations 38, 39, 25 and 27. The straps may then be brought across the back or over the shoulders and fastened behind the back of the worker. In addition, instead of using the preferred Velcro covered fastener tabs, other securing means using magnetic force of clips, for example, in each case larger than the grommet holes, may be employed. Accordingly, the present invention is not limited to the configuration precisely shown in the drawings.

What is claimed is:

1. An apron and apron fastening assembly comprising:

an apron having first and second straps extending from the upper right and left corners, respectively, of the apron:

first and second grommets having, holes of a predetermined diameter extending through the grommets, said grommets being secured in and to the right and left sides of said apron, respectively;

one of said straps extending from the upper left corner of said apron through the grommet on the right side of said and the other of said straps extending from the upper right corner of said apron through the grommet on the left side of said apron;

first and second fastener tabs having a cross-sectional size greater than said predetermined diameter of said grommets;

means for securing the ends of said straps to said fastener tabs; and means for removably securing said first and second fastener tabs directly to one another.

2. An assembly as defined in claim 1 wherein said securing means including Velcro-type material of one type on said first fastener and Velcro-type material of the mating type on said second fastener tab.

3. An apron fastener assembly as defined in claim 1 wherein said first and second fastener tabs include a thin rigid plate.

4. An apron fastener assembly as defined in claim 1 wherein said means for securing said fastener tabs to said apron straps includes a loop or a ring secured to said fastener tabs and said straps.

5. An apron fastener assembly as defined in claim 3 wherein said thin rigid plate is formed of metal.

6. An apron fastener assembly as defined in claim 3 wherein said thin rigid plate is formed of plastic.

7. An apron fastener assembly as defined in claim 3 wherein said thin rigid plate is formed of rubber.

8. An apron and apron fastening assembly comprising:

an apron having first and second straps extending from the upper right and left corners, respectively, of the apron:

first and second grommets having holes of a predetermined diameter extending throughout the grommets, said grommets being secured in and to the right and left sides of said apron, respectively;

one of said straps extending from the upper left corner of said apron through the grommet on the right side of said apron and the other of said straps extending from the upper right corner of said apron through the grommet on the left side of said apron;

first and second fastener tabs having a cross-sectional size greater than said predetermined diameter of said grommets;

means for removably securing said first and second fastener tabs together, said means constituting mating velcro pads mounted, respectively, on said fastener tabs.

9. A simple apron fastener assembly as defined in claim 8 wherein said fastener tabs are made of flexible material.

10. A simple apron fastener assembly as defined in claim 8 wherein said fastener tabs are made of rigid material.

* * * * *